US006908335B1

(12) United States Patent
Chen et al.

(10) Patent No.: US 6,908,335 B1
(45) Date of Patent: Jun. 21, 2005

(54) CONNECTOR FOR A FLEXIBLE PRINTED CIRCUIT BOARD

(75) Inventors: Tsai-Fu Chen, Taoyuan (TW); Wen-Long Chung, Taoyuan (TW)

(73) Assignee: P-Two Industries, Inc., Taoyuan (TW)

( * ) Notice: Subject to any disclaimer, the term of this patent is extended or adjusted under 35 U.S.C. 154(b) by 0 days.

(21) Appl. No.: 10/890,092

(22) Filed: Jul. 14, 2004

(51) Int. Cl.[7] ..... H01R 12/24
(52) U.S. Cl. ..... 439/495
(58) Field of Search ..... 439/485, 260, 439/263, 495, 261

(56) References Cited

U.S. PATENT DOCUMENTS 6,056,572 A * 5/2000 Matsumoto et al. ..... 439/260
6,755,682 B2 * 6/2004 Kunishi et al. ..... 439/495

* cited by examiner

*Primary Examiner*—Phuong Dinh
(74) *Attorney, Agent, or Firm*—Troxell Law Offices, PLLC

(57) ABSTRACT

A connector including pivoting parts at both ends of a locking part to be connected and pivoted to the main body of the connector. A through hole is installed at the corresponding location of a supporting arm of a terminal. A pivoting and rotating part is installed at the inner wall of said hole. The front end of the supporting arm of the terminal is installed with a through-hole-penetrating elastic compression part and a dented part accompanied with a pivoting, part. At the front end of the contact arm of the terminal is installed with a guiding arm. First and second protruding parts are installed respectively on the guiding arm allowing the elastic compression part and dented part to tightly compress the pivoting and rotating part of the locking part when the locking part is locked. The first protruding part and FPCB form a compressing and holding action to each other.

4 Claims, 3 Drawing Sheets

CONNECTOR FOR A FLEXIBLE PRINTED CIRCUIT BOARD

BACKGROUND OF THE INVENTION

1. Field of the Invention

This invention relates to a connector, it relates specifically a connector, which can effectively prevent Flexible Printed Circuit Board (abbreviated as FPCB) from getting loose.

2. Description of the Related Art

Printed circuit board is an indispensable basic component for electronic product, it needs to possess flexible characteristics when it is used in circuit where "moving function" is necessary, therefore, flexible printed circuit board with light weight and small form factor has been invented for this industry, it allows three dimensional circuit layout possible due to limited space and size in the product, therefore, electronic, communication or military application, where light weight, thin profile, and small size are important, will need FPCB.

Since FPCB is of light weight and thin and flexible, therefore, when it is used in the connection in electronic circuit, as shown in FIG. 1, the connection end of FPCB 1' has to be connected by connector 2' in order to enhance its mechanical strength, on the main body of connector 2' is installed with slot 21' for the fixing of terminal 22', furthermore, FPCB 1' is inserted into slot 21', a locking part 23' is used to form a close contact between FPCB 1' and the contact arm 221' of terminal 22', terminal 22' further forms connection between flexible printed circuit 1' and the electronic circuit designed and installed in connector 2'. Moreover, when FPCB 1' operates and moves along with the electronic circuit it is connected to, certain degree of teasing and pulling actions are going to appear between FPCB 1' and connector 2' and the connection could thus gets loose; therefore, the terminal 22' of connector 2' is a structure comprising a protruding part 222' located at the contact side of its contact arm 221' which is in contact with FPCB 1', this structure allows FPCB 1' to be inserted in between contact arm 221' and locking part 23' when the locking part 23' of connector 2' has not been locked toward contact arm 221', furthermore, contact arm 221' can generate an elastic distortion when the locking part 23' compresses and locks toward contact arm 221' such that locking part 23' can compresses, locks and positions, the elastic force from the contact arm 221' can force protruding part 222' compresses to ward FPCB 1' in order to increase the combining strength between FPCB 1' and terminal 22'.

Nevertheless, in the prior art connector 2', the supporting arm 223' of terminal 22' forms a pivoting and limiting action on the locking part, although the protruding part 222' of the contact arm 221' of the terminal 22' can form a compression action on the FPCB 1' when locking part 23' is completely locked and compressed, but this compression action comprising of only the spring force coming from contact arm 221', this seems to be not enough to hold tight the FPCB 1', moreover, the elastic force of contact arm 221' will decay with time, the compression force between contact arm 221' and FPCB 1' will then be reduced, bad connection can thus happen unpredictably between FPCB 1' and the electronic circuit, or FPCB 1' can even get loose.

SUMMARY OF THE INVENTION

This invention aims at improving the drawbacks of the prior art connector and it fits the real application demand, a connector to be applied in the flexible printed circuit is invented for industrial application.

Technical means is adopted in this invention, a supporting arm which extends into the slot is installed at the base of the terminal, furthermore, at both ends of the locking part are installed with pivoting parts to be connected to the main body of the connector, in the mean time, through hole is installed at the corresponding location to the supporting arm of the terminal, the inner wall of the through hole is a pivoting and rotating part which is of floating and protruding shape, moreover, the front end of the supporting arm of the terminal is installed with a curved and through-hole-penetrating elastic compression part and a dented part accompanied with a pivoting part, therefore, when the locking part is in action, the pivoting and rotating part of locking part face directly the dented part of supporting arm, it allows the curved elastic compression part and dented part in the front end of supporting arm to form a tight compression and liming action such that bouncing away of locking part can be well prevented and in turn it can further prevent FPCB from getting loose, this is the main purpose of the current invention.

Yet another purpose of the current invention, the terminal structure comprising of a slot which can be inserted into a connector to be connected to FPCB, moreover, a guiding arm is installed at the front end of the contact arm of the terminal, first protruding part and second protruding part installed at the guiding arm and of fixed length are protruding toward FPCB and the inner wall of slot, respectively, through the guiding action of the guiding arm, it can lead FPCB to enter correctly the space between contact arm and the locking part, therefore, when the locking part locks, locking part compresses and positions by using the elastic distortion of contact arm and guiding arm, moreover, when the locking part locks completely, the first protruding part of the guiding arm can compress and hold tight FPCB, moreover, the second protruding part and the inner wall of slot can touch each other and form a supporting function ,this supporting function can limit the distortion of guiding arm in the reverse direction, therefore, the compression action put on FPCB by first protruding part can be maintained, and the combination strength between FPCB and terminal can be greatly enhanced, a loose connection of FPCB can thus be prevented.

Yet another purpose of the current invention, spring piece can be installed further at the slot of the connector, spring piece and the pivoting part of the locking part compresses to each other, in the mean time, protruding and dented lock which can hold and lock to each other when the locking part locks completely are installed at the contact location between the spring piece and the pivoting part, dented lock and protruding lock can further enhance the limiting function of the locking part, therefore, when the elastic distortion force of the contact arm and supporting arm of terminal disappears, locking part won't bounce away before it receives a reverse action force, locking part can still form a stable and tight compression between FPCB and terminal.

Further another purpose of the current invention, between the arm surface of the guiding arm and the wall of slot, a buffer zone is formed, when a thicker FPCB is inserted, it not only causes elastic distortion at the contact arm, but also causes a second elastic distortion at the buffer zone of contact arm, therefore, bouncing away or breaking of locking part can be prevented.

DETAILED DESCRIPTION OF THE INVENTION

Figure 1:
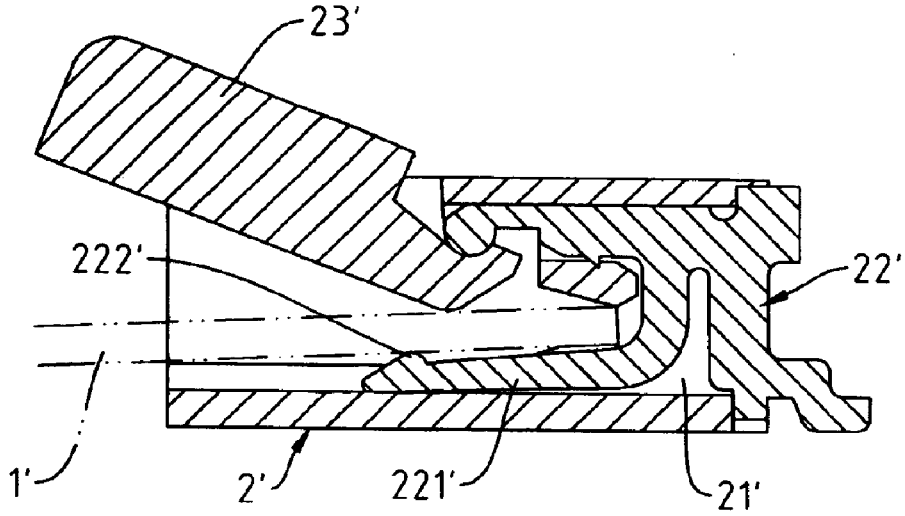
Fig. 1 Prior Art
FIG. 1 shows a flexible printed circuit board is inserted in the prior art connector.
Figure 2:
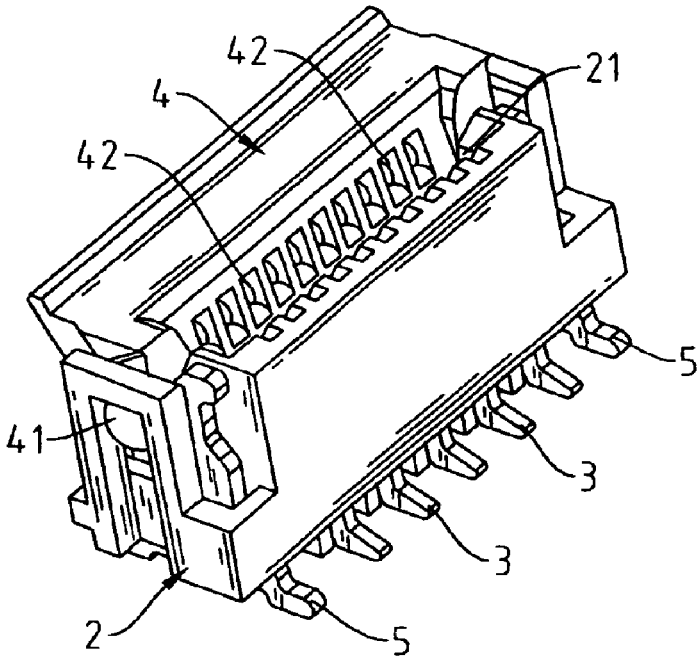
FIG. 2 shows the appearance of the connector for the current invention.
Figure 3:
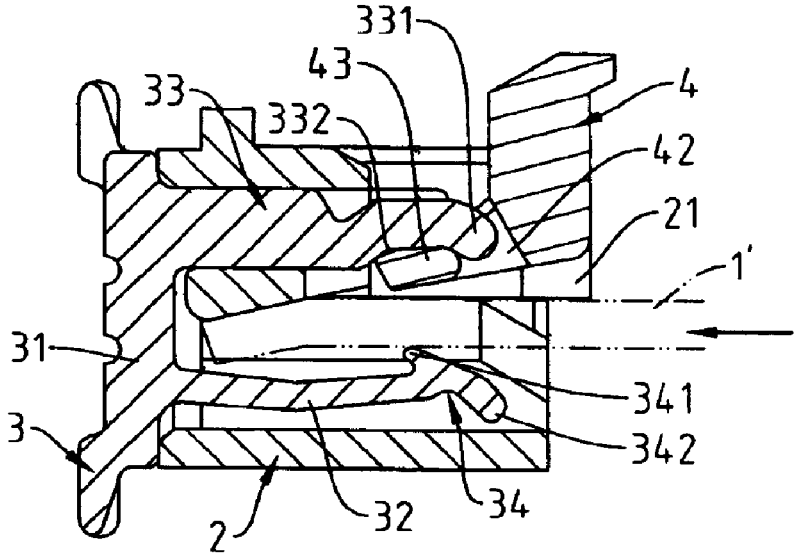
FIG. 3 shows a flexible printed circuit board is inserted in the connector of the current invention.

Please refer to FIGS. 2 and 3, the connector of the current invention is installed with a slot 21 on its main body 2, terminal 3 is installed and fixed inside slot 21 such that FPCB 1 can be inserted into slot 21 to be connected to terminal 3, and a locking part 4 which can compress terminal 3 and FPCB 1 is installed at one side of slot 21, it is used to increase the combination strength between FPCB 1 and terminal 3.

The above-mentioned terminal 3 has a base 31 which is installed with fixed length contact arm 32 and supporting arm 33 which are further inserted in the slot 21 of connector 2, the front end of the supporting arm 33 is installed with curved and through-hole-penetrating elastic compression part 331 and a dented part 332 accompanied with a pivoting part, furthermore, a guiding arm 34 is installed in the front end of the contact arm 32, first protruding part 341 and second protruding part 342 installed at the guiding arm 34 and of fixed length are protruding toward FPCB 1 and the inner wall of slot 21 respectively, guiding arm 34 can guide FPCB 1 to move correctly into the space between contact arm 32 and locking part 22, moreover between the arm surface of the guiding arm 33 and the wall of slot 21, a buffer zone is formed ,when a thicker FPCB 1 is inserted, it not only causes elastic distortion at the contact arm 32, but also causes a second elastic distortion at the buffer zone of contact arm 33, therefore, bouncing away or breaking of locking part 22 can be prevented.

The above-mentioned locking part 4 has pivoting part 41 installed at both ends of it in order to be connected to the main body 2 of the connector, in addition, through hole 42 is installed at the corresponding location to the supporting arm 33 of terminal 3, the inner wall of through hole 42 is a pivoting and rotating part 43 which is protruding and floating.

Figure 4:
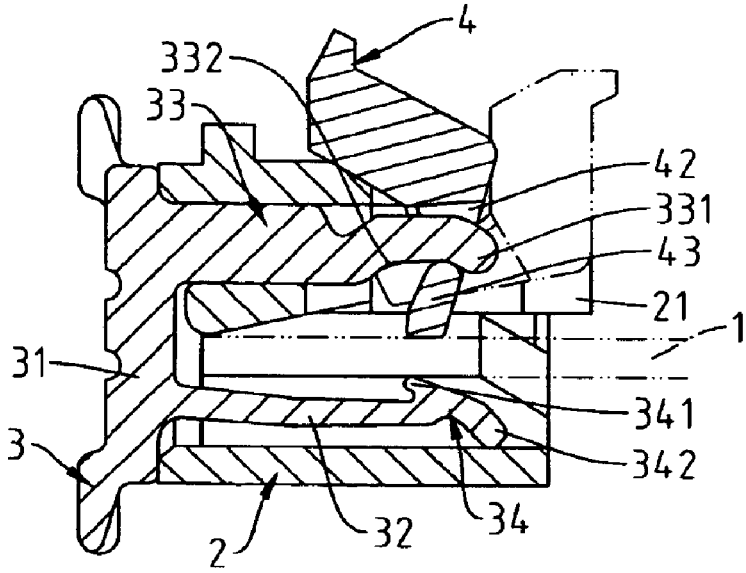
FIG. 4 shows a flexible printed circuit board is inserted and locked in the connector of the current invention.

Therefore, as shown in FIG. 4, when the locking part 4 is in action, the pivoting and rotating part 43 of locking part 4 face directly the dented part 332 of supporting arm 33, furthermore, locking part 4 compresses and positions by using the elastic distortion of contact arm 32 and guiding arm 34 of terminal 3, moreover, when the locking part 4 locks completely, it allows the curved elastic compression part 331 and dented part 332 in the front end of supporting arm 33 to form a tight compression and liming action such that bouncing away of locking part 4 can be well prevented and in turn it can further prevent FPCB from getting loose, in the mean time , the first protruding part 341 of the guiding arm 34 can compress and hold tight FPCB 1, moreover, the second protruding part 342 and the inner wall of slot 21 can touch each other and form a supporting function, this supporting function can limit the distortion of guiding arm 34 in the reverse direction, therefore, the compression action put on FPCB 1 by first protruding part 341 can be maintained ,and the combination strength between FPCB 1 and terminal 3 can be greatly enhanced , a loose connection of FPCB 1 can thus be prevented.

Figure 5:
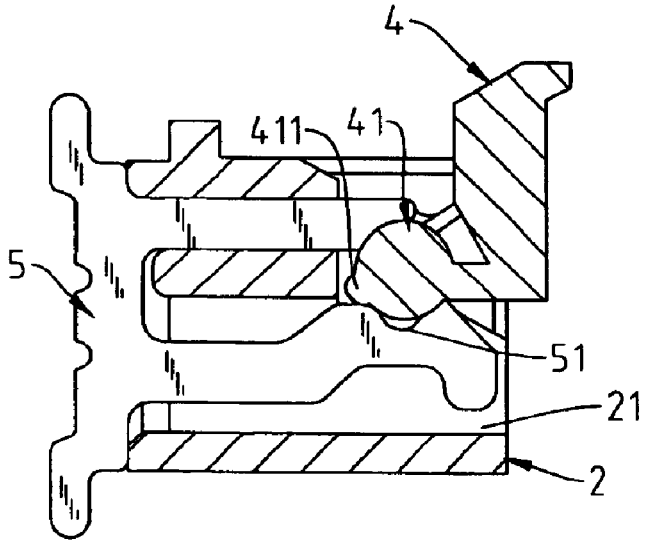
FIG. 5 shows an assembly relationship between the locking part and spring piece of the connector of the current invention.

Further as shown in FIG. 5, spring piece 5 is installed additionally in the slot 21 of the connector of the current invention, spring piece 5 compress to the pivoting part 41 of the locking part 4, dented lock 51 and protruding lock 411 which can lock and hold to each other after locking pail 4 performs its locking action are installed at the contact location of spring piece 5 and pivoting part 41, dented lock 51 and protruding lock 411 further enhances the limiting action of locking part 4, therefore, when the elastic distortion force of the contact arm 32 and supporting arm 33 of terminal 3 disappears, locking part 2 won't bounce away before it receives a reverse action force, locking part 2 can still form a stable and tight compression between FPCB 1 and terminal 3.

Summarize the above descriptions, the connector provided by this invention can not only greatly enhance the combination strength of FPCB 1, but also remain the expected connection between FPCB 1 and electronic circuit, it can further prevent a loose connection of FPCB 1 when it moves frequently along with the electronic circuit it is connected to, this invention is of great industry utility value.

What is claimed is:

1. A connector for a flexible printed circuit board comprising:

a) a main body having a slot with an inner bottom wall;

b) a plurality of terminals, each of the plurality of terminals inserted into the main body and having:

i) abase;

ii) a contact arm extending from a bottom of the base into the slot;

iii) a supporting arm extending from a top of the base into the slot and having a compression part located on an end opposite the base and a dented part located between the compression part and the base; and iv) a guiding arm located on an end of the contact arm opposite the base, the flexible printed circuit board being inserted into the slot between contract arm and the supporting arm and engaging the guiding arm; and c) a locking part movable between released and locked positions and having:

i) two pivoting parts, each of the two pivoting parts being located on one of two opposing ends of the locking part and pivotally connecting the locking part and the main body;

ii) a plurality of through holes, the supporting arm of each of the plurality of terminals being inserted into one of the plurality of through holes; and iii) a pivoting and rotating part formed on an inner wall of each of the plurality of through holes and engaging the compression part of each supporting arm, wherein, in the released position, a front of the locking part is rotated downwardly toward the flexible printed circuit board, the pivoting and rotating part is spaced apart from the flexible printed circuit board, and the guiding arm is spaced apart from the inner bottom wall of the slot, and in the locked position, the front of the locking part is rotated upwardly away from the flexible printed circuit board, the pivoting and rotating part engaging the flexible printed circuit board, and the guiding arm engaging the inner bottom wall of the slot.

2. The connector according to claim 1, further comprising a spring piece inserted into the slot and having a dented lock, the pivoting and rotating part of the locking part having a protruding lock engaging the dented lock when the locking part is in the locked position.

3. The connector according to claim 1, wherein each guiding arm having a first protruding part engaging the flexible printed circuit board and a locked protruding part extending toward the inner bottom wall of the slot.

4. The connector according to claim 3, wherein, in the released position, each second protruding part is spaced apart from the inner bottom wall of the slot, and in the locked position, each second protruding part engaging the inner bottom wall of the slot.

* * * * *